United States Patent [19]

Gagnebin et al.

[11] Patent Number: 4,781,035

[45] Date of Patent: Nov. 1, 1988

[54] NON EXPANDING BRACELET WITH VISIBLE HINGES

[75] Inventors: Gaston Gagnebin; Michel Cattin, both of Bienne, Switzerland

[73] Assignee: Omega S.A., Bienne, Switzerland

[21] Appl. No.: 15,187

[22] Filed: Feb. 13, 1987

[30] Foreign Application Priority Data

Feb. 14, 1986 [FR] France ..... 86 02128

[51] Int. Cl.[4] ..... A44C 5/10

[52] U.S. Cl. ..... 63/4; 59/82

[58] Field of Search ..... 63/4, 9, 3, 20, 7, 11, 63/5 R; 59/80, 82

[56] References Cited

U.S. PATENT DOCUMENTS

| | | | |
|---|---|---|---|
| 1,822,393 | 9/1931 | Fassnacht | 59/80 |
| 1,836,772 | 12/1931 | Rossman | 24/459 |
| 2,626,736 | 1/1953 | Korth | 63/29 R |
| 2,702,451 | 2/1955 | Schwaibold | 63/4 X |
| 4,269,026 | 5/1981 | Bulle et al. | 59/82 |
| 4,355,501 | 10/1982 | Tesch | 63/4 |

FOREIGN PATENT DOCUMENTS

| | | | |
|---|---|---|---|
| 0081464 | 6/1983 | European Pat. Off. . | |
| 1440172 | 4/1966 | France . | |
| 2287869 | 5/1976 | France . | |
| 233245 | 10/1944 | Switzerland . | |
| 646851 | 12/1984 | Switzerland | 59/82 |

*Primary Examiner*—Richard J. Johnson

*Attorney, Agent, or Firm*—Griffin, Branigan, & Butler

[57] ABSTRACT

This bracelet comprises a succession of elements linked together by means of hinges, each element including a median knuckle on one side and two end knuckles on the opposite side between which the median knuckle of the neighbouring element fits. Both median and end knuckles are integrally formed with the element to which they belong. Each is sheathed with a jacket for decorative purposes.

13 Claims, 2 Drawing Sheets

NON EXPANDING BRACELET WITH VISIBLE HINGES

FIELD OF THE INVENTION

This invention concerns a non-expanding bracelet including a plurality of elements linked together in succession, each of said elements including a median knuckle on one side, and two end knuckles on the opposite side, the median knuckle of one element fitting between the end knuckles of the neighbouring element so as to form in association with a connecting means a visible hinge.

A bracelet such as has just been defined hereinabove is well known to the state of the art and in a very general manner may be formed in accordance wtih FIG. 1 attached to the present description.

BACKGROUND OF THE INVENTION

The bracelet is made up of a series of elements 1 linked together in succession. In order to form said linkages each element 1 comprises on one side a median knuckle 2 and on the opposed side two end knuckles 3. At the left of FIG. 1 will be seen two elements 1 prior to assembly and at the right two assembled elements forming a visible hinge 4. The median knuckle 2 is dimensioned so as to fit comfortably between two end knuckles 3. As soon as the knuckles are aligned, there is introduced coupling means 5 here partially shown in the form of a pin. Additionally, one may improve the aspect of the bracelet by using studs 6 which blank off the visible opening of the end knuckles 3.

In this type of construction, knuckles 2 and 3 are assembled following their formation to the elements 1 to which they belong. This generally is brought about by welding or brazing. When the elements 1 and the knuckles 2 and 3 are formed from the same material (e.g. steel), the weld does not constitute a problem and exhibits good resistance to the stresses which may be applied thereto. On the other hand, if the materials are different with the purpose of providing the bracelet with a special aesthetic aspect (bracelet occasionally referred to as bicoloured), welding between elements 1 and knuckles 2 and 3 may no longer be absolutely guaranteed and there are substantial risks of rupture of said weld. It has been especially noted that when it is a question of welding gold knuckles onto steel elements, the reliability of such welded joints leaves much to be desired. It should likewise be mentioned that following welding of such knuckles it is necessary to rework the elements in order to polish them and to give them a satin finish this constituting an additional element of cost.

Patent documents EP-A-0 081 464 and U.S. Pat. No. 1,836,772 disclose respectively a bracelet formed from articulated links, the hinges of which are not visible, and a bracelet with a system for attaching it to a watch such system employing a split jacket to facilitate the length adjustment of the bracelet. Even considered in combination however these two documents do not suggest the idea of this invention as set forth in the present description and which permits the obtaining of special aesthetic effects, in particular the decoration of a hinge to which two successive links are articulated through the use of three separate juxtaposed jackets.

SUMMARY OF THE INVENTION

This invention provides a solution to the problem hereinabove mentioned and is characterized in that the median and end knuckles are integrally formed with the element of which they constitute a part and that they are each sheathed with a jacket for decorative purposes.

DESCRIPTION OF THE PREFERRED EMBODIMENT

Figure 2:
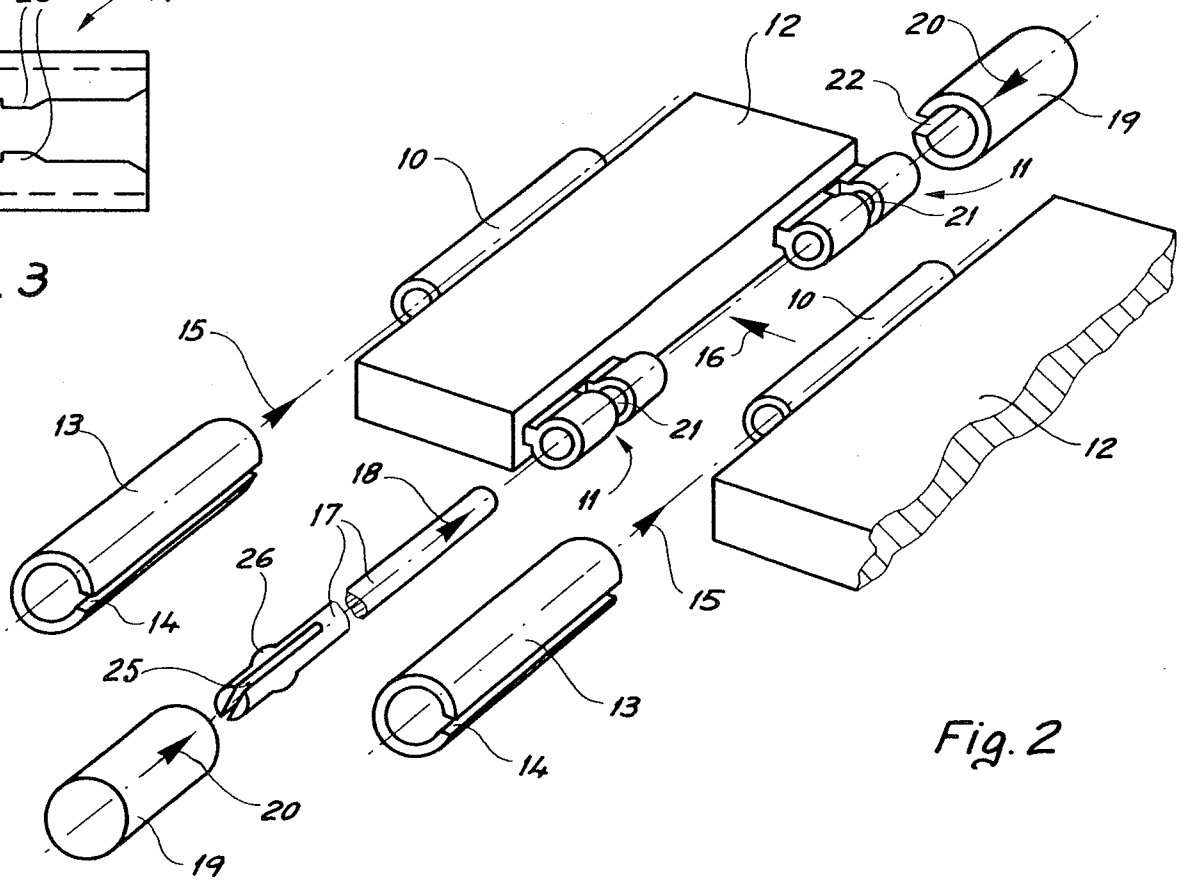
FIG. 2 is an exploded perspective view of a portion of the bracelet according to the invention.

A portion of the bracelet according to the invention is shown in exploded perspective on FIG. 2. In order to assure perfect retention of the median knuckles 10 and end knuckles 11 on elements 12, said knuckles are integrally formed with said elements. In order to achieve such forming, several solutions are possible.

In one case element 12 includes a central core (not visible on the drawing) surrounded by an envelope, for instance a tube which is machine pressed around the core in a manner to form continuous knuckles on either side of the element. These knuckles are thereafter cut to length as is seen on FIG. 2.

In another solution, one may employ a massive shaped bar which exhibits projections on either side of its longitudinal direction which are thereafter folded over in order to form the knuckles. Such knuckles are thereafter cut to the required length.

In either of the proposed solutions the knuckles are cut in a manner such that the space left between two end knuckles 11 is substantially the same as the length of a median knuckle 10.

Thereafter, the knuckle 10 is sheathed with a jacket forming the decoration thereof. In order to carry out this operation, one may start with a sheet which is rolled around knuckle 10. A preferred solution however and which is shown on FIG. 2 consists of employing a tube 13 provided with a longitudinal slot 14 and which is thereafter slid in the sense of arrow 15 over knuckle 10. It will be understood that tube 13 is cut to the length of the knuckle 10.

As soon as this operation has been carried out, the knuckle 10 provided with jacket 13 is fitted between the two end knuckles 11 in the sense of arrow 16, then the hinge between two elements 12 is completed by employing a coupling means shown in the form of a pin 17 which is inserted in the sense of arrow 18. Pin 17 may be held in place by appropriate means known to the state of the art. An original fastening means will however be shown hereinafter.

There remains then to sheathe each of the end knuckles 11 with a jacket forming the decoration in order to complete the joint. In the example shown in FIG. 2, these jackets take the form of split caps 19 which are slid onto knuckles 11 in the sense of arrow 20. In order to be retained in position, these caps 19 may be press fitted and glued or eventually press fitted and crushed onto the end knuckles 11. Another original solution will be shown hereinafter.

Thus according to the description which has just been given, elements 12 and knuckles 10 and 11 which form an integral part thereof are formed of the same material, for instance of steel. Tubes 13 and caps 19 may be realized of gold, in which case the bracelet exhibits alternately an element in steel and a hinge in gold. Other variants are possible wherein the tube 13 is of steel and the caps 19 are gold or vice versa.

Figure 1:
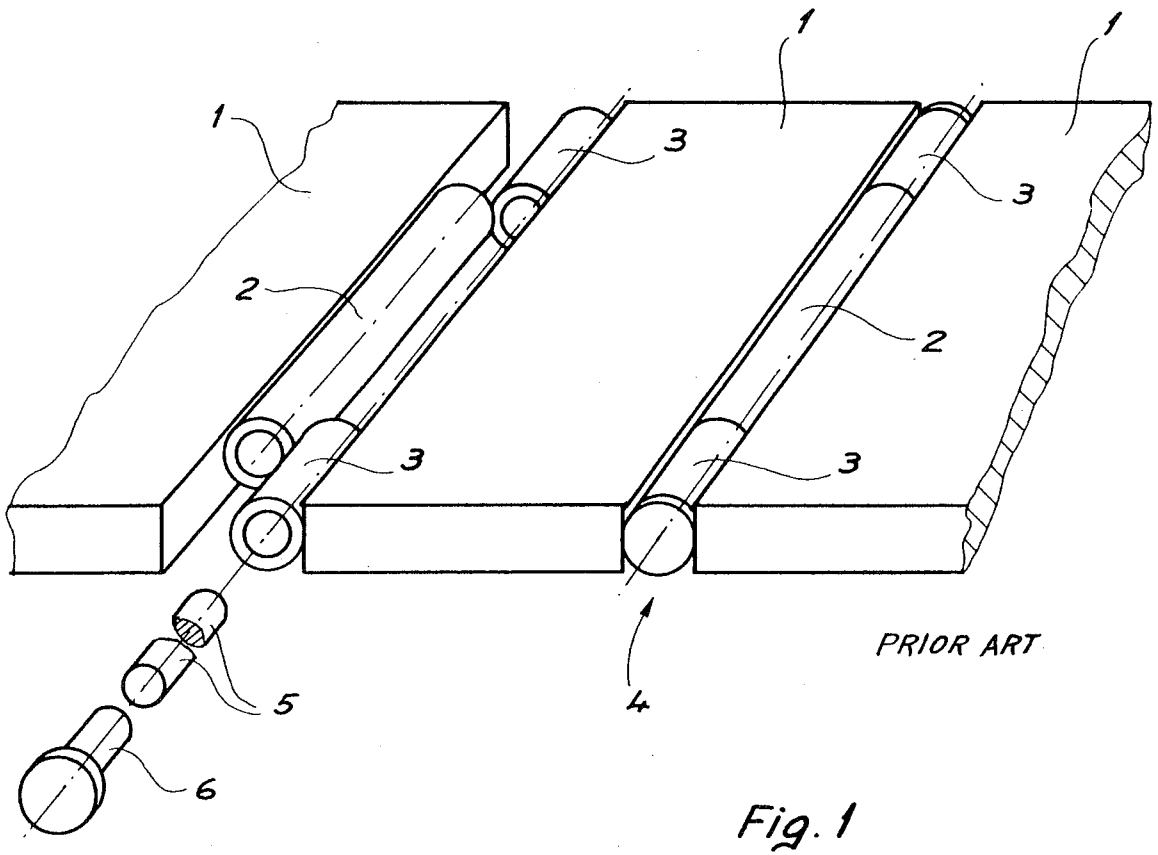
FIG. 1 illustrates a bracelet formed in accordance with the prior art.

In addition to the advantage already mentioned hereinabove which is that of providing a very strong bracelet, the invention likewise enables a saving in the weight of gold, since this precious metal is used only for the tubes and the caps and no longer for the entire knuckles as was the case of the construction described in respect of figure 1 representing the prior art.

FIG. 2 further shows a variant in the construction which, although non essential, facilitates to a great extent the fastening of the pin 17 and the caps 19. In this case, each of the end knuckles 11 is provided substantially at its center with a diametral slot 21 which slot extends right up to element 12. This slot facilitates at the same time the fastening of pin 17 and caps 19.

Figure 3:
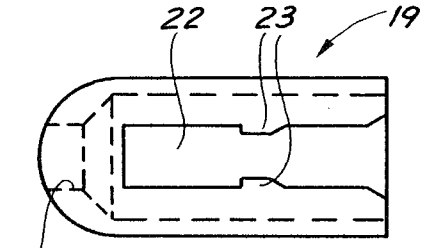
FIG. 3 is a plan view of a piece serving to decorate the end knuckles composing the elements of the bracelet as shown on FIG. 2.

In this case and further referring as well to figure 3, it is seen that cap 19 includes in addition to slot 22, thanks to which it may slide over knuckle 11, protuberances 23 forming a part of this slot. Such protuberances 23 are arranged to be notched into slot 21 when the cap 19 is mounted onto knuckle 11. As may be seen on figure 3, the form of the protuberances is such that the cap, once introduced onto the knuckle, may not be removed. The same figure shows further that the bottom of the cap may be pierced with a hole 24, which permits removal of the pin 17 in order to adjust the length of the bracelet.

As is seen on FIG. 2, pin 17 is provided with a slot 25 extending partially over its length and further bears a fillet 26. It is understood that slot 25 gives the pin a certain elasticity which enables the fillet to lodge itself into slot 21 when the pin is in place.

What we claim is:

1. A non-expanding bracelet including a plurality of elements linked together in succession, each of said elements including a median knuckle on one side and two end knuckles on the opposite side, the median knuckle of one element fitting between the end knuckles of the neighbouring element so as to form in association with a connecting means a visible hinge, the median and end knuckles being integral with the element of which they form a part and each being sheathed with a jacket for decorative purposes, the jacket covering the median knuckle comprising a tube which is longitudinally split and slid over said median knuckle prior to fitting in of the knuckles forming the hinge.

2. A non-expanding bracelet including a plurality of elements linked together in succession, each of said elements including a median knuckle on one side and two end knuckles on the opposite side, the median knuckle of one element fitting between the end knuckles of the neighbouring element so as to form in association with a connecting means a visible hinge, the median and end knuckles being integral with the element of which they form a part and each being sheathed with a jacket for decorative purposes, the jacket covering each end knuckle comprising a longitudinally split cap.

3. A non-expanding bracelet including a plurality of elements linked together in succession, each of said elements including a median knuckle on one side and two end knuckles on the opposite side, the median knuckle of one element fitting between the end knuckles of the neighbouring element so as to form in association with a connecting means a visible hinge, the median and end knuckles being integral with the element of which they form a part and each being sheathed with a jacket for decorative purposes, each end knuckle being provided substantially at its center with a diametral cut, said cut extending to the element to which said end knuckle belongs.

4. A bracelet as set forth in claim 3 wherein the jacket covering each end knuckle comprises a cap having a longitudinal slot, said slot bearing a protuberance arranged to latch into the diametral cut of the end knuckle when the cap is mounted on said end knuckle.

5. A bracelet as set forth in claim 3 wherein the connecting means between the median knuckle and the end knuckles comprises a pin at least partially split in the sense of its length and bearing a fillet serving to fix said pin when said fillet penetrates the cut of one of the end knuckles.

6. In a non-expanding bracelet including a plurality of elements linked together in succession, each of said elements including a median knuckle on one side and two end knuckles on the opposite side, the median knuckle of one element fitting between the end knuckles of the neighboring element so as to form, in association with a connecting means, a visible hinge, the median and end knuckles being integral with the element of which they form a part, the improvement comprising a plurality of decorative jackets, one associated with each of said knuckles, each of said jackets comprising a longitudinally split tubular element adapted to slide over its associated knuckle, whereby said decorative jackets are visible between adjacent ones of said elements.

7. A bracelet as set forth in claim 6 wherein the jacket covering the median knuckle is of steel and the jackets covering the end knuckles are of gold.

8. A bracelet as set forth in claim 6 wherein the jacket covering the median knuckle is of gold and the jackets covering the end knuckles are of steel.

9. A bracelet as set forth in claim 6 wherein the jacket covering the median knuckle as well as the jackets covering the end knuckles are of gold.

10. A bracelet as set forth in claim 6 wherein the jacket covering each end knuckle comprises a longitudinally split cap.

11. A bracelet as set forth in claim 6 wherein each end knuckle is provided substantially at its center with a diametral cut, said cut extending to the element to which said end knuckle belongs.

12. A bracelet as set forth in claim 11 wherein the jacket covering each end knuckle comprises a cap having a longitudinal slot, said slot bearing a protuberance arranged to latch into the diametral cut of the end knuckle when the cap is mounted on said end knuckle.

13. A bracelet as set forth in claim 11 wherein the connecting means between the median knuckle and the end knuckles comprises a pin at least partially split in the sense of its length and bearing a fillet serving to fix said pin when said fillet penetrates the cut of one of the end knuckles.

* * * * *